United States Patent [19]

Yokoo et al.

[11] Patent Number: 4,818,128

[45] Date of Patent: Apr. 4, 1989

[54] IMPACT PRINTER CAPABLE OF BEING EQUIPPED WITH AN AUTO SHEET FEEDER

[75] Inventors: Kyoichi Yokoo; Takehiko Nanbu, both of Tokyo, Japan

[73] Assignees: Kabushiki Kaisha Toshiba, Kawasaki; Toshiba Computer, Engineering Corporation, Oume, both of Japan

[21] Appl. No.: 866,316

[22] Filed: May 23, 1986

[30] Foreign Application Priority Data

May 31, 1985 [JP] Japan ..... 60-117826
Jul. 31, 1985 [JP] Japan ..... 60-169122

[51] Int. Cl.[4] ..... B41J 9/38

[52] U.S. Cl. ..... 400/166; 400/57; 400/624; 400/157.3

[58] Field of Search ..... 400/57, 157.3, 166, 400/624–629; 101/93.03

[56] References Cited

U.S. PATENT DOCUMENTS 4,243,331 1/1981 Savage ..... 400/57 X
4,384,520 5/1983 Nakano ..... 400/157.3 X
4,452,543 6/1984 Adkisson ..... 400/625 X

FOREIGN PATENT DOCUMENTS 3305320 8/1983 Fed. Rep. of Germany ... 400/157.3
38277 4/1981 Japan ..... 400/157.3
120374 9/1981 Japan ..... 101/93.03
39978 3/1982 Japan ..... 400/57
96868 6/1982 Japan ..... 400/57
128882 8/1983 Japan ..... 400/157.3

*Primary Examiner*—Paul T. Sewell
*Attorney, Agent, or Firm*—Foley & Lardner, Schwartz, Jeffery, Schwaab, Mack, Blumenthal & Evans

[57] ABSTRACT

An impact printer which can be equipped with an auto sheet feeder comprises printing means, driving means for driving the printing means and controlling means for controlling the driving means so as to reduce the printing strength of the printing means when equipped with the auto sheet feeder. The impact printer makes it possible to reduce impact noises even when equipped with the auto sheet feeder, without lowering the quality of the characters, etc. printed.

3 Claims, 8 Drawing Sheets

IMPACT PRINTER CAPABLE OF BEING EQUIPPED WITH AN AUTO SHEET FEEDER

BACKGROUND OF THE INVENTION

The present invention relates to an impact printer.

The impact printer is characterized by the fact that the printer can produce plural hard copies of output data at a time by using carbon paper or no-carbon paper. Recently, a dot matrix type impact printer has been becoming increasingly popular for use in electronic devices for the business purpose, such as wordprocessors, because it can easily accommodate a variety of fonts. The impact strength of the printer is adjusted beforehand for printing plural sheets (superimposed) of paper so that the printer can clearly print characters on every one of the sheets of paper. This impact strength is not changeable depending on types of paper, number of sheets to be printed, or others. This results in the problem that the printer makes loud noises and wastes electrical energy when the printer prints characters on a single sheet (not superimposed) of paper, for example, when the printer is equipped with an auto sheet feeder which feeds one sheet to the printer at a time.

SUMMARY OF THE INVENTION

An object of the present invention is to provide an impact printer which can print characters, etc. without making a loud noise even when equipped with an auto sheet feeder.

To achieve the object, the present invention provides an impact printer which can be equipped with an auto sheet feeder, comprising: printing means; means for driving said printing means; and means for controlling said driving means so as to reduce the printing strength of said printing means when equipped with said auto sheet feeder.

DETAILED DESCRIPTION OF THE INVENTION

A First Embodiment

An impact printer according to a first embodiment of the present invention will be described with reference to FIGS. 1 to 6.

Figure 1A:
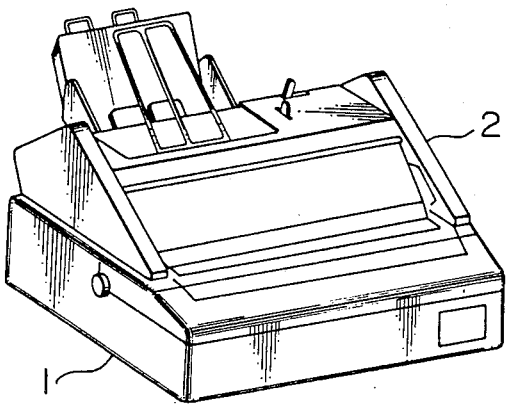
FIGS. 1*a* and 1*b* are a perspective view and a side view showing an impact printer according to a first embodiment of the present invention, respectively.
Figure 1B:
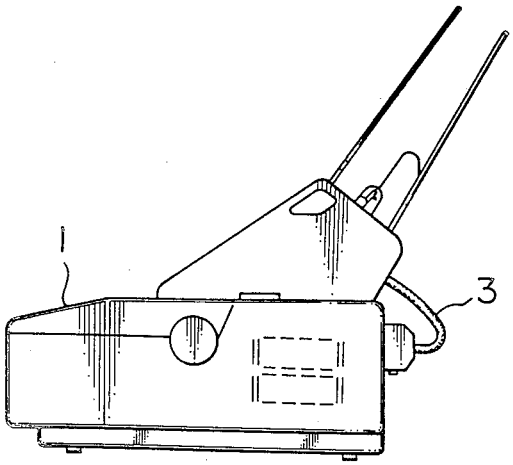

FIGS. 1*a* and 1*b* show the impact printer 1 which is equipped with an auto sheet feeder 2. The auto sheet feeder 2 is mounted on the impact printer 1. The auto sheet feeder 2 includes a sheet feed motor (not shown) connected to a power supply by a cable 3. The cable 3 interconnects the auto sheet feeder 2 and the impact printer 1.

Figure 2:
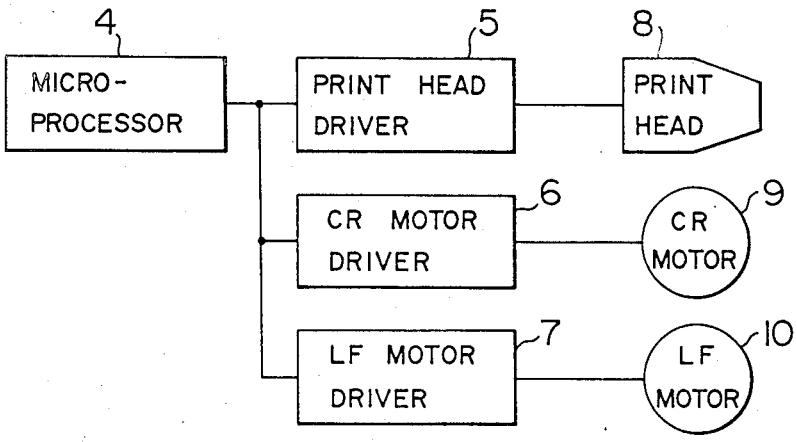
FIG. 2 is a block diagram showing the impact printer.

FIG. 2 shows the impact printer 1. The impact printer has a microprocessor 4 which controls the impact printer 1 to function properly. A print head driver 5, a CR (carriage return) motor driver 6, and an LF (line feed) motor driver 7 are connected to the microcomputer 4. The print head driver 5 drives a print head 8 on the basis of instructions from the microprocessor 4 so that the print head 8 prints characters, etc. The CR motor driver 6 drives a CR motor 9 which moves a carriage (not shown) carrying the print head 8 on the basis of instructions from the microprocessor 4. The LF motor driver 7 drives an LF motor 10 which rotates a platen (not shown) on the basis of instructions from the microprocessor 4 to shift a sheet.

Figure 3:
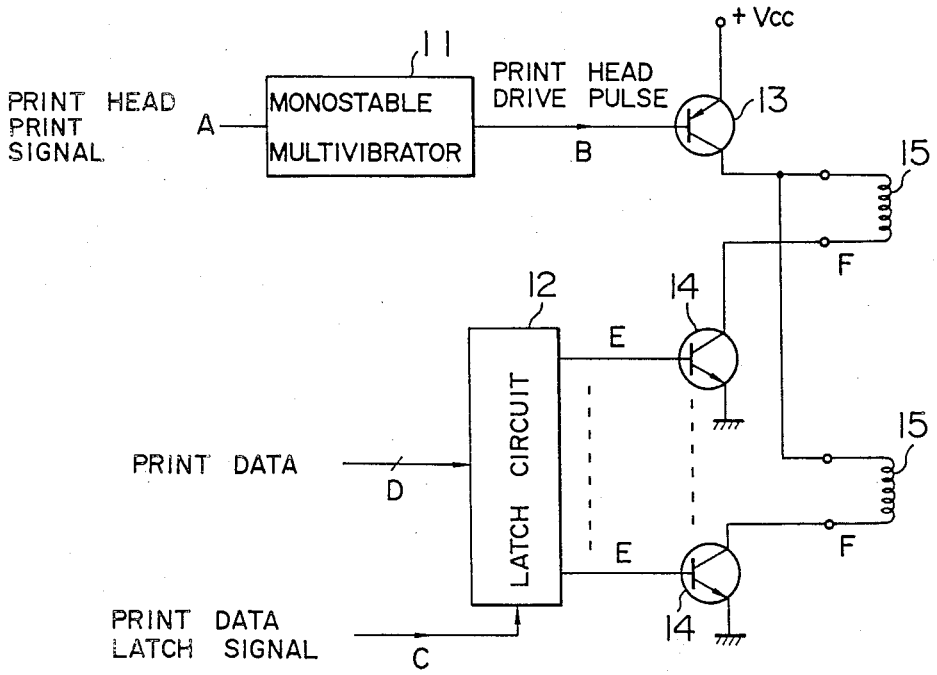
FIG. 3 is a block diagram showing a basic example of a print head driver of the impact printer.

FIG. 3 shows a basic example of the print head driver 5. A print head print signal A from the microprocessor 4 is inputted to a monostable multivibrator 11. A print head drive pulse B from the monostable multivibrator 11 is applied to the base of a driving transistor 13. A print data D from the microprocessor 4 is inputted to a latch circuit 12. A data latch signal C controlling when the print data D is latched, is inputted to the latch circuit 12. The latch circuit 12 latches the print data D to apply ON signals in accordance with the print data D to control transistors 14, respectively. The control transistors 14 control currents flowing through plural coils 15 in the print head, respectively. The driving transistor 13 is connected between a power terminal Vcc and a common node connected to the end of the respective coils 15. Each of the control transistors 14 is connected between ground and the other end of each of the coils 15.

Figure 4:
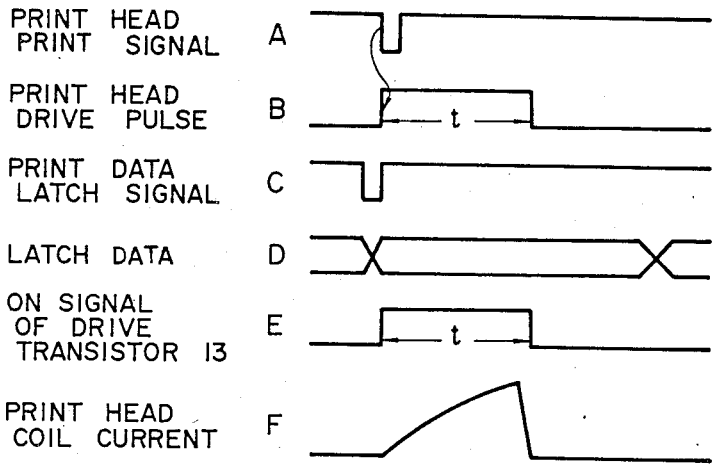
FIG. 4 is a timing chart showing signals in the basic example.

The operation of the basic example of the print head driver 5 will be described in reference to FIG. 4. First, the latch circuit 12 latches the print data D in response to a fall of the data latch signal C. When the print head print signal A is inputted to the monostable multivibrator 11, the monostable multivibrator 11 outputs a print drive pulse B of a predetermined duration t. the print drive pulse B turns on the drive transistor 13. The control transistors 14 are turned on or off in accordance with the print data D latched by the latch circuit 12. Thus the print data D determines only the coils 15 to be activated. Each of the currents through the coils 15 gradually increases in amount to fall down immediately after the duration time t has passed as shown in FIG. 4. The thus determined wires of the print head 8 impact on a sheet through an ink ribbon to print the determined dots on the sheet.

Figure 5:
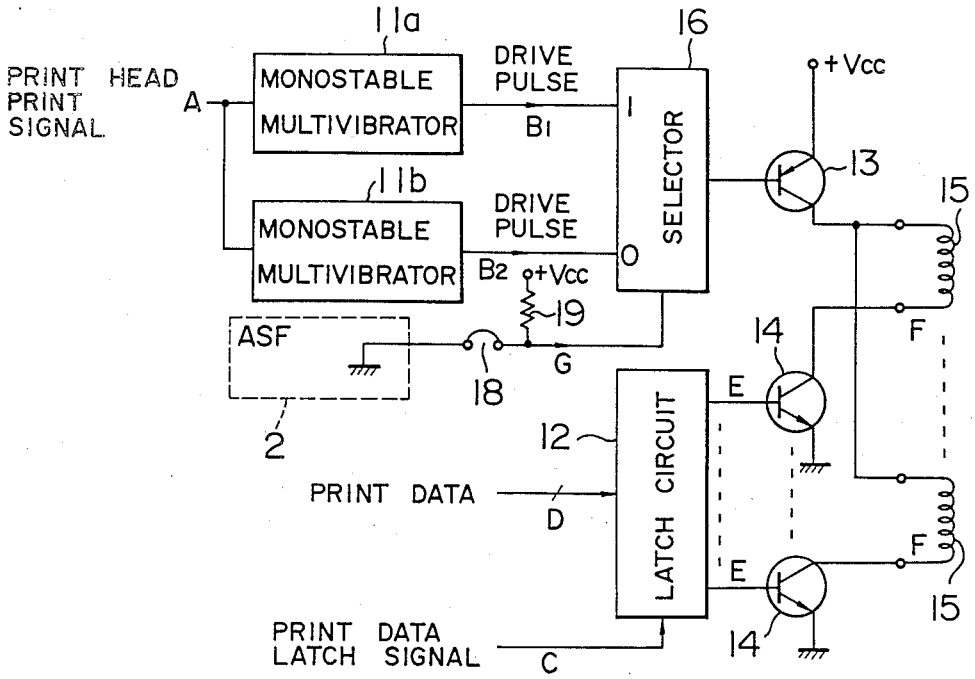
FIG. 5 is a block diagram showing an example of the print head driver.

FIG. 5 shows an example of the print head driver 5 of the impact printer 1. Instead of the monostable multivibrator 11 of the basic example in FIG. 3, this example comprises two monostable multivibrators 11*a* and 11*b* which generate different pulses B1 and B2, respectively. The example further comprises a selector 16 having two inputs connected to the monostable multivibrators 11*a* and 11*b* respectively and one output connected to the base of the drive transistor 13. A select input of the selector 16 is connected to a connector 18 through a line. A register 19 is inserted between the line and the power terminal Vcc. The connector 18 is connected to one terminal of the auto sheet feeder 2. The terminal is grounded. Thus when the impact printer 1 is not equipped with the auto sheet feeder 2, a high level select signal G is inputted to the select input of the selector 12. When the impact printer 1 is equipped with the auto sheet feeder 2, a low level select signal G is inputted to the select input of the selector 12. The selector 12 selects either of the output signals B1 and B2 from the monostable multivibrators 11*a* and 11*b* according to the level of the select signal G inputted to the selector 12. The output signal from the selector 12 is inputted to the base of the drive transistor 13.

Figure 6:
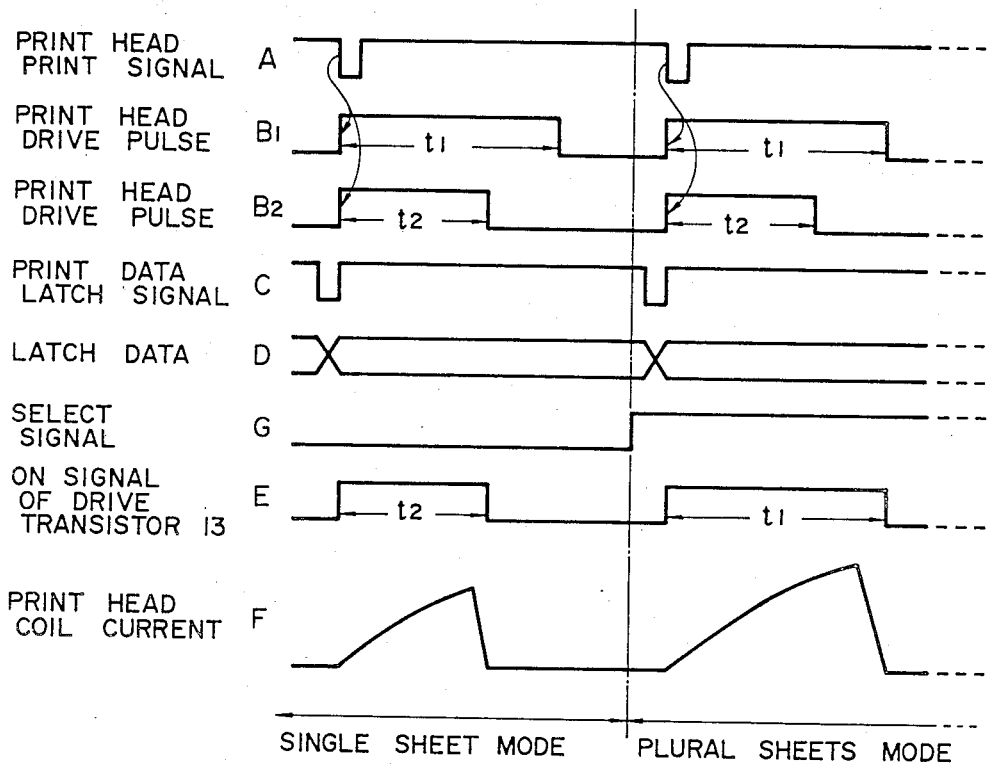
FIG. 6 is a timing chart showing signals in the example.

The operation of the example of the print head driver 5 will be described with reference to FIG. 6. When the auto sheet feeder 2 is equipped, a low level select signal G is inputted to the select input of the selector 12, where the printing is for single sheet of paper (hereinafter called "single sheet mode"). The latch circuit 12 latches the print data D in response to a fall of the data latch signal C. In response to a fall of the print head print signal A, the monostable multivibrator 11*a* generates a print head drive pulse B1 of a long duration $t_1$ and the monostable multivibrator 11*b* generates a print head drive pulse B2 of a short duration $t_2$. In the single sheet mode, the print head drive pulse B2 from the monostable multivibrator 11*b* is selected by the selector 16 because a large drive current is not required. Thus the drive transistor 13 can turn on only for the short duration $t_2$, and the currents through the coils 15 of the print head 8 are small enough for the print head 8 to print characters, etc. without making loud noises as shown in FIG. 6.

When the auto sheet feeder 2 is not equipped, a high level select signal G is inputted to the select input of the selector, where the printing is for plural sheets of paper (hereinafter called "plural sheets mode"). In the plural sheets mode, the print head drive pulse B5 from the monostable multivibrator 11 is selected by the selector 16 because a large drive current is required. Thus the drive transistor 13 can turn on for the long duration $t_1$, and the currents through the coils 15 of the print head 8 are large enough for the print head 8 to print characters, etc. on every one of the plural sheets of paper as shown in FIG. 6.

As described above, the first embodiment makes it possible to reduce impact noises even when equipped with the auto sheet feeder, without lowering the quality of the characters, etc. printed. Where the impact printer is used for the business purpose usually with the auto sheet feeder in an office room which is expected to be quiet, the impact noises can be considerably reduced.

Figure 7:
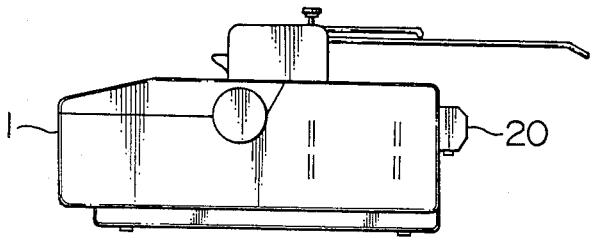
FIG. 7 is a side view showing another example of the impact printer.

FIG. 7 shows another example of the impact printer, in which the impact printer prints character, etc. on a continuous form of paper by using a tractor. In this example, the auto sheet feeder is not used, but a dummy connector 20 is used as shown in FIG. 7, and the dummy connector 20 permits the impact printer 1 to print on a single continuous form of paper.

A SECOND EMBODIMENT

An impact printer according to a second embodiment of the present invention will be described with reference to FIGS. 8 to 15.

Figure 8:
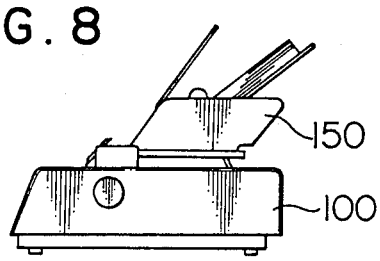
FIG. 8 is a side view showing an impact printer according to a second embodiment of the present invention.

FIG. 8 shows the impact printer 100 equipped with an auto sheet feeder 150. The auto sheet feeder 150 is a continuous type mechanical auto sheet feeder. In the impact printer 100 equipped with the continuous type mechanical auto sheet feeder 150, a platen roller of the impact printer 100 rotates continuously, whereby cut (separate) sheets of paper are fed at a given interval from a hopper of the auto sheet feeder 150 to the impact printer 100 one by one.

The auto sheet feeder 150 is mechanically connected to the impact printer 100 so that power is transmitted from the impact printer 100 to the auto sheet feeder 150 through a mechanical connection. Thus no cable for supplying an electrical power is required.

Figure 9A:
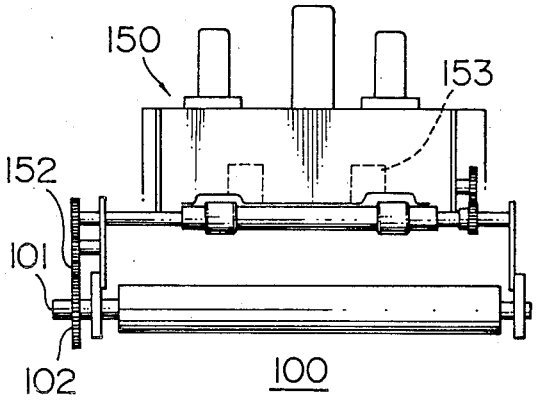
FIGS. 9*a* and 9*b* are views showing the impact printer equipping an auto sheet feeder.
Figure 9B:
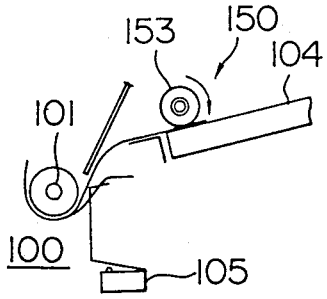
Figure 10:
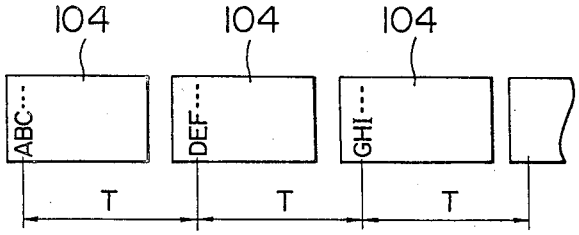
FIG. 10 is a view showing sheets fed by the auto sheet feeder.

FIGS. 9*a* and 9*b* show the impact printer 100 mechanically equipped with the auto sheet feeder 150. A gear 152 of a pickup roller 153 in the auto sheet feeder 150 is meshed with a gear 102 of a platen 101 in the impact printer 100. Thus the pickup roller 153 and the platen 101 are rotated together, so that a single (not superimposed) discontinuous form of paper 104 is fed to the impact printer 100 one by one. The interval of adjacent sheets 104 is determined by a gear ratio of gears in the auto sheet feeder 150. The interval is typically 15 inches. The length of one sheet 104 is usually shorter than 15 inches, e.g., A4 size (8.3"×11.7") or letter size (8.5"×14"). Thus, as shown in FIG. 10, between adjacent sheets 104 fed by the auto sheet feeder 150 there is a space in which no sheet of paper is present.

There is provided a switch 105 for detecting the presence of paper as shown in FIG. 9*b*. The switch 105 can detect the trailing end of the continuous form of paper. When the switch 105 detects the absence of paper, the impact printer 100 automatically stops printing.

When the auto sheet feeder 150 is equipped to feed discontinuous sheets of paper 104 to the impact printer 100, it is necessary to make an output signal of the switch 105 invalid. This is because the space, in which no sheet of paper is present, intermittently occurs between adjacent sheets 104.

Figure 11:
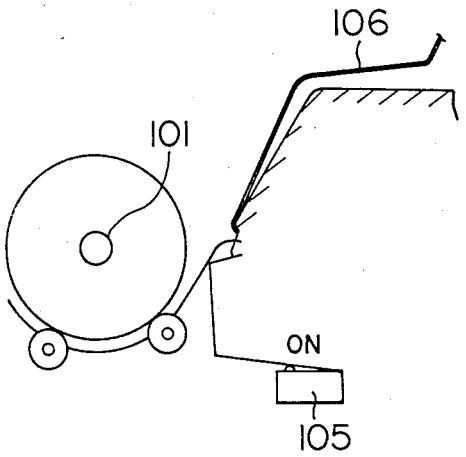
FIG. 11 is a side view showing an impact printer with a mechanism making a paper end switch invalid.

There are two methods for making the detect switch 105 invalid. A first method is as follows: a plate 106 always turns on the switch 105 as shown in FIG. 11. A second method is as follows: there is provided a DIP switch having a bit which indicates whether an output signal of the switch 105 is valid or invalid, the bit being switched so that the output signal of the switch 105 is invalid. This embodiment uses the second method.

Figure 12:
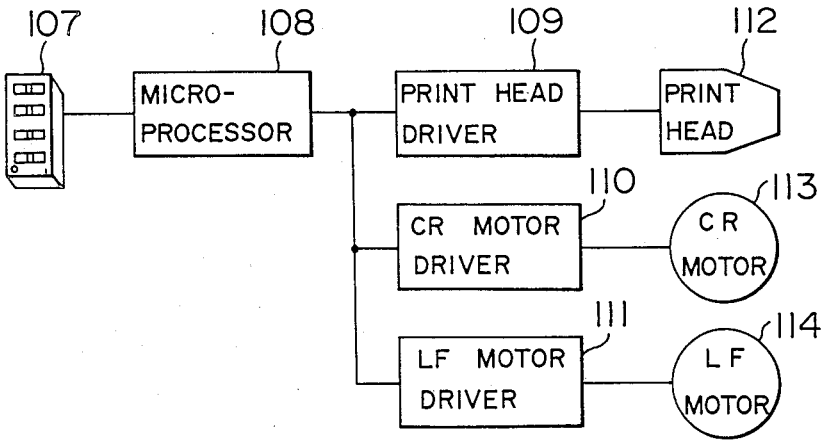
FIG. 12 is a block diagram showing the impact printer according to the second embodiment.

FIG. 12 shows the impact printer 100. The impact printer 100 has a microprocessor 108 which controls the impact printer 100 to function properly. A print head driver 109, a CR (carriage return) motor driver 110, and an LF (line feed) motor driver 111 are connected to the microcomputer 108. The print head driver 109 drives a print head 112 on the basis of instructions from the microprocessor 108 so that the print head 112 prints characters, etc. The CR motor driver 110 drives a CR motor 113 which moves a carriage (not shown) carrying the print head 112 on the basis of instructions from the microprocessor 108. The LF motor driver 111 drives an LF motor 114 which rotates a platen (not shown) on the basis of instructions from the microprocessor 108 to shift a sheet.

Figure 13:
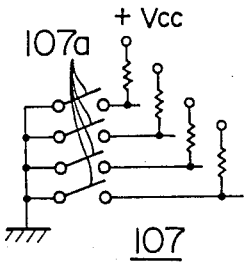
FIG. 13 is a circuit diagram showing a DIP type switch used in the impact printer.

A DIP switch 107 is connected to the microprocessor 108. The DIP switch 107 has a switching bit which determines whether the output signal of the switch 105 is valid or invalid. FIG. 13 shows the DIP switch 107 in detail. Depending on the state of the switching bits, the DIP switch 107 outputs a high or low level signal. The microprocessor 108 reads the output signals of the DIP switch 107 to make the output signal of the switch 105 valid or invalid.

Figure 14:
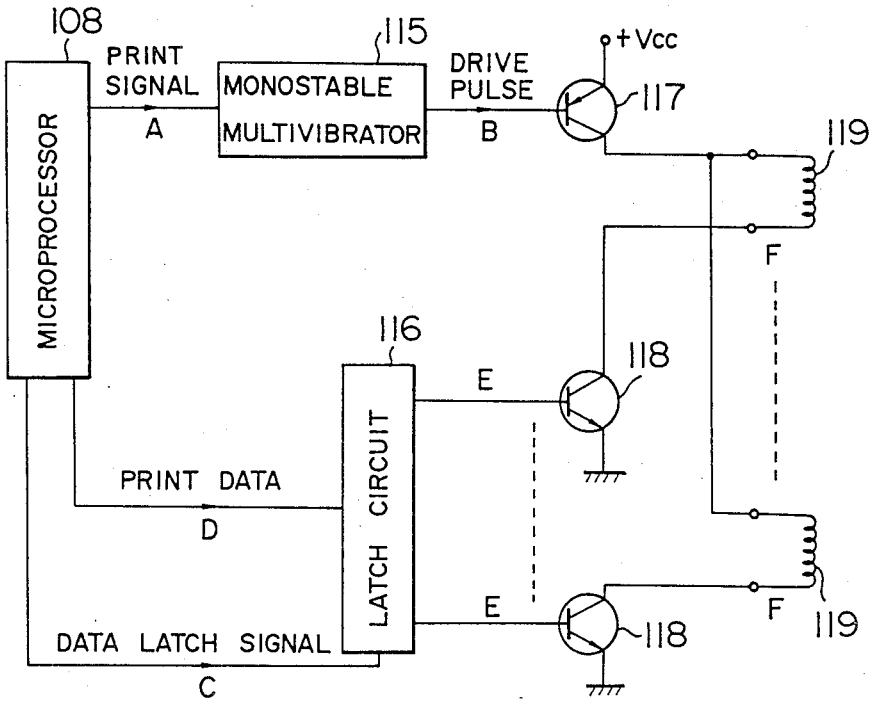
FIG. 14 is a block diagram showing a basic example of a print head driver of the impact printer.

FIG. 14 shows a basic example of the print head driver 109. A print head print signal A from the microprocessor 108 is inputted to a monostable multivibrator 115. A print head drive pulse B from the monostable multivibrator 115 is applied to the base of a driving transistor 117. A print data D from the microprocessor 108 is inputted to a latch circuit 116. A data latch signal C controlling when the print data D is latched, is inputted to the latch circuit 116. The latch circuit 116 latches the print data D to apply ON signals in accordance with the print data D to control transistors 118, respectively. The control transistors 118 control currents flowing through plural coils 119 in the print head, respectively. The driving transistor 117 is connected between a power terminal Vcc and a common node connected to the end of the respective coils 119. Each of the control transistors 118 is connected between ground and the other end of each of the coils 119.

Figure 15:
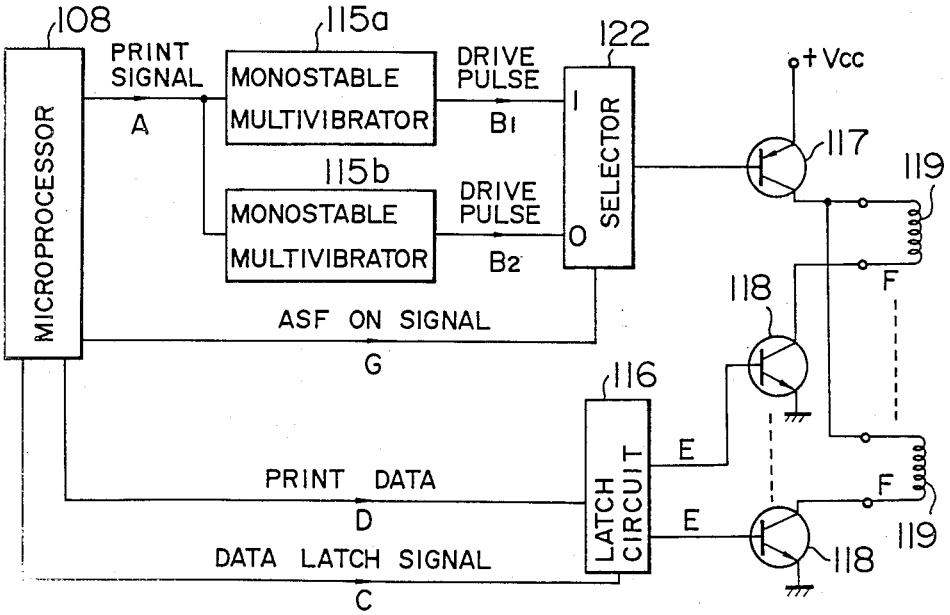
FIG. 15 is a block diagram showing an example of the print head driver.

FIG. 15 shows an example of the print head driver 109 of the impact printer 100. Instead of the monostable multivibrator 115 of the basic example in FIG. 14, this example comprises two monostable multivibrators 115*a* and 115*b* which generate different pulses B1 and B2, respectively. The duration $t_1$ of pulses B1 is longer than the duration $t_2$ of pulse B2. The example further comprises a selector 122 having two inputs connected to the monostable multivibrators 115*a* and 115*b* respectively and one output connected to the base of the drive transistor 117. The selector 122 further has a select input to which an ASF (auto sheet feeder) on signal G is inputted. The microprocessor 108 generates the ASF on signal G in accordance with the DIP switch 107 which indicates whether or not the auto sheet feeder 150 is equipped. The selector 122 selects either of the pulses B1 and B2 in accordance with the ASF on signal G.

Figure 16:
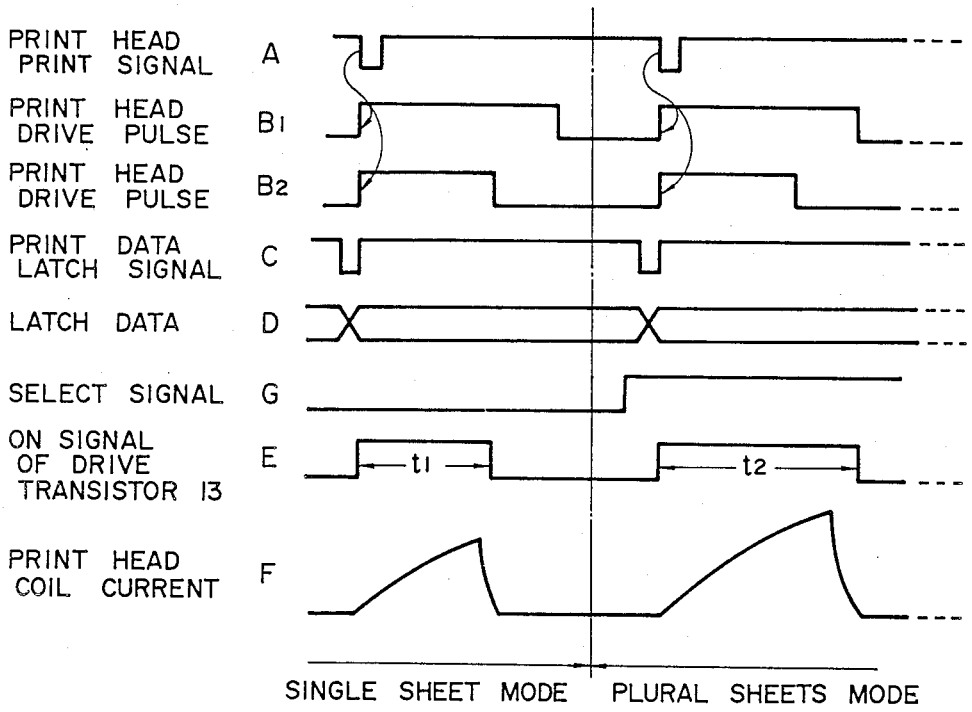
FIG. 16 is a timing chart showing signals in the example.

The operation of the example of the print head driver 109 will be described with reference to FIG. 16. First, the bit of the DIP switch 107 is set in accordance with whether the detect switch 105 is to be valid or invalid. The microprocessor 108 outputs the ASF on signal G in accordance with the DIP switch 107 to the selector 122. In other words, the ASF on signal G is a low level when the detect switch 105 is invalid (when the auto sheet feeder 150 is equipped), and the ASF on signal G is a high level when the detect switch 105 is valid (when the auto sheet feeder 150 is not equipped).

The selector 122 selects either of the drive pulses B1 and B2 according to the ASF on signal G. When the ASF on signal G is a low level, the selector 122 selects the drive pulse B2 from the monostable multivibrator 115*b*. The drive transistor 117 is on for the shorter time $t_1$than time $t_2$. Thus, the coils 119 generates a low energy for printing. The current wave form F through each of the coils 119 is shown in FIG. 16.

When the ASF on signal G is a high level, the selector 122 selects the drive pulse B1 from the monostable multivibrator 115*a*. The drive transistor 117 is on for the longer time $t_2$ than time $t_1$. Thus, the coils 119 generate a high energy for printing. The current wave form F through each of the coils 119 is shown in FIG. 16.

As a result, the coils 119 generate different energy depending on whether or not the auto sheet feeder 150 is equipped.

As described above, the second embodiment makes it possible to reduce impact noises even when equipped with the auto sheet feeder, by utilizing the information of the bit of the DIP switch which determines whether the detect switch is valid or invalid.

The present invention may be practiced or embodied in still other ways without departing from the spirit or essential character thereof.

The second embodiment changes the printing energy by utilizing the information of the bit of the DIP switch which determines whether the detect switch is valid or invalid. The impact printer, however, may comprise a switch only for designating whether or not the auto sheet feeder is equipped. The impact printer may change the printing energy by utilizing the information of the switch.

This is particularly effective for the impact printer equipped with a demand type mechanical auto sheet feeder. In the printer equipped with the demand type mechanical auto sheet feeder, a platen roller of the impact printer rotates in a specific may only when sheets of paper are needed, whereby cut (separate) sheets of paper are fed from a hopper of the auto sheet feeder to the impact printer one by one. In an example of this type, when sheets of paper are needed, the platen roller makes a given clockwise and counter-clockwise rotation, and then a clutch of a mechanism is connected for transmitting the rotary force of the platen roller to a feed roller of the auto sheet feeder. Then the platen roller rotates oppositely by a given angle, whereby cut (separate) sheets of paper are fed from the hopper of the auto sheet feeder to the platen. Therefore, it is not necessary to make the detect switch for detecting the presence of paper invalid when equipped with the demand type mechanical auto sheet feeder.

Additionally, the DIP switch can be replaced by any type switch for switching the detect switch to make an output signal of the detect switch valid or invalid.

What is claimed is:

1. An impact printer which can be equipped with an auto sheet feeder, comprising:

printing means;

means for driving said printing means;

means for detecting whether or not said auto sheet feeder is equipped; and controlling means for controlling said driving means so that printing strength of said printing means is reduced in accordance with an output signal of said detecting means below the printing strength for plural sheets of paper on the basis of an output signal of said detecting means, when said impact printer is equipped with said auto sheet feeder, said controlling means comprising a first pulse generating means for generating a first pulse in response to a print signal which drives said printing means;

a second pulse generating means for generating a second pulse in response to said print signal, the pulse width of said second pulse being shorter than said first pulse; and selecting means for selecting either of said first pulse and said second pulse on the basis of the result of said detecting means, whereby said driving means drives said printing means according to the pulse selected by said selecting means, said first and second pulse generating means having monostable multivibrators, and said driving means having a driving transistor, the pulse selected by said selecting means being applied to the base of said driving transistor.

2. An impact printer which can be equipped with an auto sheet feeder, comprising:

printing means;

means for driving said printing means;

means for detecting the presence of paper;

means for producing an output signal of said detecting means valid or invalid; and controlling means for controlling said driving means so that printing strength of said printing means reduced in accordance with an output signal of said producing means below the printing strength for plural sheets of paper on the basis of an output signal of said means for producing, when said impact printer is equipped with said auto sheet feeder;

said controlling means comprising a first pulse generating means for generating a first pulse in response to a print signal which drives said printing means, a second pulse generating means for generating a second pulse in response to said print signal, the pulse width of said second pulse being shorter than said first pulse, and means for selecting either of said first pulse and said second pulse on the basis of the result of said means for producing output signal of said detecting means valid or invalid, whereby said driving means drives said printing means according to the pulse selected by said selecting means, said first and second pulse generating means having monostable multivibrators, said driving means having a driving transistor, the pulse selected by said selecting means being applied to the base of said driving transistor.

3. An impact printer which can be equipped with an auto sheet feeder, comprising;

printing means;

means for driving said printing means; and means for designating whether or not said auto sheet feeder is equipped; and means for controlling said driving means so that printing strength of said printing means is reduced in accordance with an output signal of said designating means below the printing strength for plural sheets of paper on the basis of an output signal of said designating means, when said impact printer is equipped with said auto sheet feeder;

said controlling means comprising a first pulse generating means for generating a first pulse in response to a print signal which drives said printing means, a second pulse generating means for generating a second pulse in response to said print signal, the pulse width of said second pulse being shorter than said first pulse, and means for selecting either of said first pulse and said second pulse on the basis of the result of said designating means, whereby said driving means drives said printing means according to the pulse selected by said selecting means, said first and second pulse generating means having monostable multivibrators, and said driving means having a driving transistor, the pulse selected by said selecting means being applied to the base of said driving transistor.

* * * * *